US005175966A

United States Patent [19]

Remke et al.

[11] Patent Number: 5,175,966

[45] Date of Patent: Jan. 5, 1993

[54] EARTH ANCHOR SYSTEM

[75] Inventors: Mark Remke, Roselle; Frank Camp, Jr., Medinah, both of Ill.

[73] Assignee: Better Bilt Products, Inc., Addison, Ill.

[21] Appl. No.: 755,531

[22] Filed: Sep. 5, 1991

[51] Int. Cl.[5] ..... E02D 5/80

[52] U.S. Cl. ..... 52/163; 52/166; 405/244; 405/259.1

[58] Field of Search ..... 405/244, 259.1, 258; 52/163, 166, 164, 162

[56] References Cited

U.S. PATENT DOCUMENTS

| | | | |
|---|---|---|---|
| 1,014,806 | 1/1912 | Burns et al. | 52/163 |
| 1,821,125 | 9/1931 | Thom | 52/163 |
| 4,611,446 | 9/1986 | Beavers et al. | 405/259.1 |
| 5,031,370 | 7/1991 | Jewett | 52/166 |

*Primary Examiner*—Dennis L. Taylor
*Attorney, Agent, or Firm*—Leydig, Voit & Mayer

[57] ABSTRACT

An earth anchor that can be driven into the ground to a desired anchoring depth and which has a tie rod extending therefrom for connection to an above-the-ground structure to be supported. The anchor is in the form of a stamped plate having a substantially flat co-planar body portion with a tapered ground entry end and with planing wings formed at a trailing end which are angled out of the plane of the body portion for guiding the anchor plate into a substantially horizontal anchoring position upon tensioning of the tie rod. The anchor plate is formed with a stepped drive rod receiving notch in the trailing end which is engageable by the head of the drive rod and which maintains the anchor plate in coaxial relation to the drive rod as it is being driven into the ground.

16 Claims, 3 Drawing Sheets

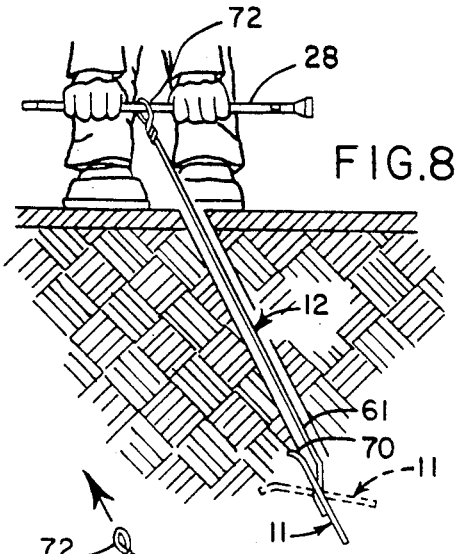
FIG.8
FIG.9
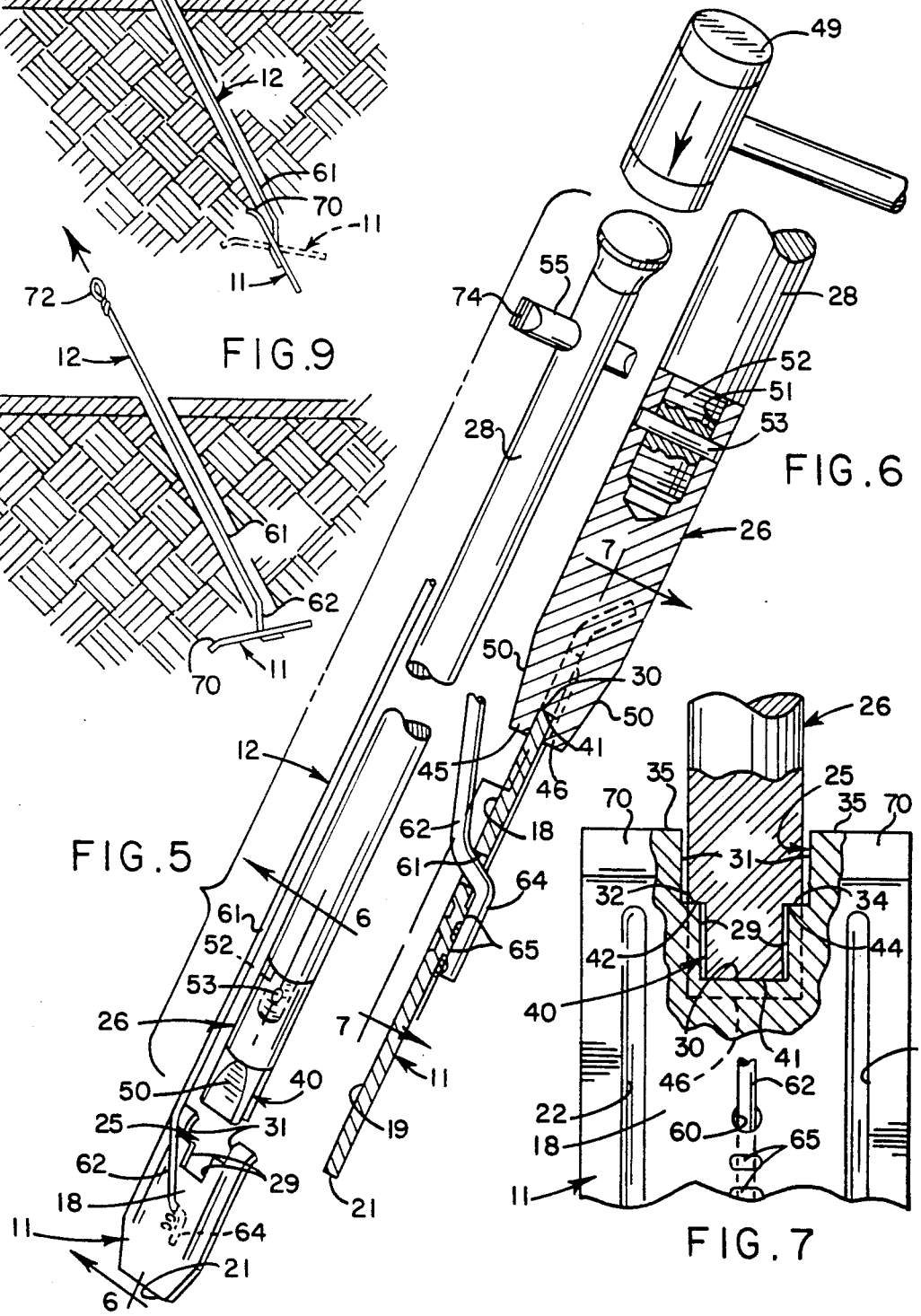
FIG.5
FIG.6
FIG.7

EARTH ANCHOR SYSTEM

FIELD OF THE INVENTION

The present invention relates generally to earth anchors, and more particularly, to earth anchors of the type which are used to support trees, tents, retaining walls, or other above the ground structures.

BACKGROUND OF THE INVENTION

Earth anchors are known which include an anchor member with an attached tie rod or cable that extends from the anchor to a location above the ground for connection to an above-the-ground structure to be supported by means of a guy wire or the like. The anchor member is driven into the ground to a predetermined depth, and then upon upward pulling or tensioning of the cable, the anchor member is drawn into a horizontal or "dead man's" anchoring position. Such anchor members commonly are in the form of a tubular or cylindrical casting having a leading end that is driven downwardly into the ground in generally vertical fashion and an upwardly curved end, which upon pulling of the tie rod, causes the anchor to move into the substantially horizontal anchoring position. Such anchors are driven into the ground by impacting the upper end of a drive rod by means of a heavy mallet or jackhammer, while the lower end of the drive rod is in engaging relation with the anchor. The anchor cable commonly is a braided metal cable or the like which is secured to the anchor by a loop that permits relative pivotal movement of the anchor during setting thereof.

Such tubular anchor members and braided anchor cables not only are relatively expensive in construction, but the anchors often are difficult to drive into the ground, particularly when they must be directed through hard frost lines during cold weather, and difficulties further arise in maintaining proper vertical orientation of the anchor when being driven deeply into the ground. Such anchors also often do not provide adequate resistance or anchoring in sandy or loose soil conditions, such as in construction zones where landscaping is being conducted. Moveover, if care is not taken when hammering the drive rod during installation of the anchor, the installer can easily injure his hands or feet. Difficulties also can arise in removing the drive rod from the ground after the anchor has been driven to a relatively deep anchoring depth.

OBJECTS AND SUMMARY OF THE INVENTION

It is an object of the present invention to provide an earth anchor that may be more quickly and easily driven deeply into the ground, even through relatively hard soil conditions and frost lines.

Another object is to provide an anchor as characterized above that is adapted for more effective anchoring, even in relatively sandy or loose soil conditions.

A further object is to provide an earth anchor that is of relatively simple construction and which lends itself to more economical manufacture.

Still anchor object is to provide an earth anchor drive rod or installation tool for facilitating proper downward driving movement of the anchor deeply into the ground without disorientation of the anchor.

Another object is to provide an earth anchor installation tool of the above type which minimizes the risk of injury to the installer during hammering of the anchor into the ground and which is adapted for easier withdrawal from the ground.

Still another object is to provide such an installation tool that further facilitates driving of the anchor and its tie rod into the ground following use thereof, if necessary, for preventing possible dangerous above ground exposure of the anchor.

Other objects and advantages of the invention will become apparent upon reference to the following detailed description and accompanying drawings, in which:

BRIEF DESCRIPTION OF THE DRAWINGS

FIG. 5 is an exploded perspective of one of the earth anchors and associated installation tool used for driving the anchor plate into the ground during installation;

FIG. 6 is an enlarged vertical section of the head of the illustrated insulation tool while in operative engagement with the anchor plate, taken in the plane of line 6—6 in FIG. 5;

FIG. 7 is an enlarged plan view, in partial section, taken in the plane of line 7—7 in FIG. 6;

FIG. 8 is a depiction illustrating setting of the anchor plate in its anchoring or "deadman's" position after being driven into the ground to a desired anchoring depth;

FIG. 9 is a depiction of the anchor plate after being set in its anchored position;

Figure 1:
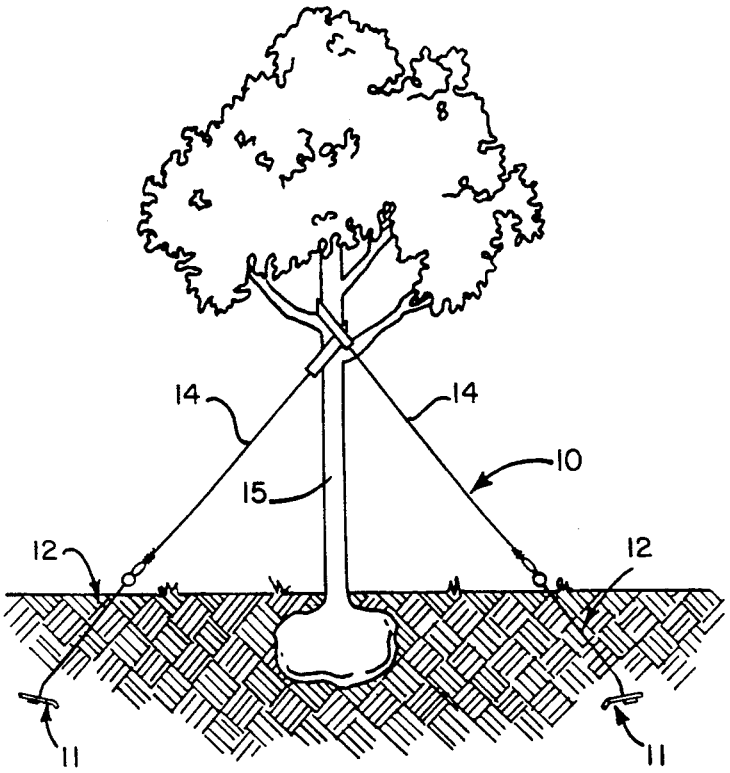
FIG. 1 is an elevational view, in partial section, of an illustrative earth anchor system embodying the present invention.

While the invention is susceptible of various modifications and alternative constructions, certain preferred embodiments thereof have been shown in the drawings and will be described below in detailed. It should be understood, however, that there is no intention to limit the invention to the specific forms described but, on the contrary, the intention is to cover all modifications, alternative constructions and equivalents falling within the spirit and scope of the invention.

DETAILED DESCRIPTION OF THE PREFERRED EMBODIMENTS

Referring now more particularly to the drawings, there is shown an illustrative anchor system 10 embodying the present invention. The anchor system 10 comprises a plurality of anchor plates 11 which each are driven into the ground to a desired anchoring depth and have a respective tie rod 12 extending out of the ground, which in turn is connected by a guy wire 14 to an above the ground structure, such as a tree 15, that is to be supported. The guy wire 14 is connected between the tree 15 and the tie rod 12 in a conventional matter.

In accordance with an important aspect of the invention, each anchor plate is stamped out of flat metal stock with a substantially flat, co-planar body portion that is tapered or pointed at a leading end to facilitate driving of the anchor into the ground through even relatively hard frost lines and which is formed with wing means at a trailing end that curve out of the plane of the body portion for directing the anchor into a substantially horizontal anchoring position upon tensioning of the tie rod after the anchor is driven into the ground to a desired anchoring depth. To this end, each anchor plate 11 may be stamped from relatively, thin-gauge flat plate steel, such as 0.092 inch gauge 1008 or 1010 galvanized steel, and is formed with an elongated co-planar body portion 18 having a tapered leading end 19. The leading end 19 in this instance is formed by inwardly and forwardly tapered sides 20 and a transverse forwardmost edge 21. Such forwardly tapered end 19 has been found to permit relatively easy and fast passage of the anchor plate 11 through even hard soil conditions and frost lines, as will become apparent. For rigidifying the anchor plate 11, the body portion 18 is formed with a pair of longitudinally extending stiffening recesses or grooves 22 adjacent opposite sides thereof, which may be formed during stamping.

Figure 2:
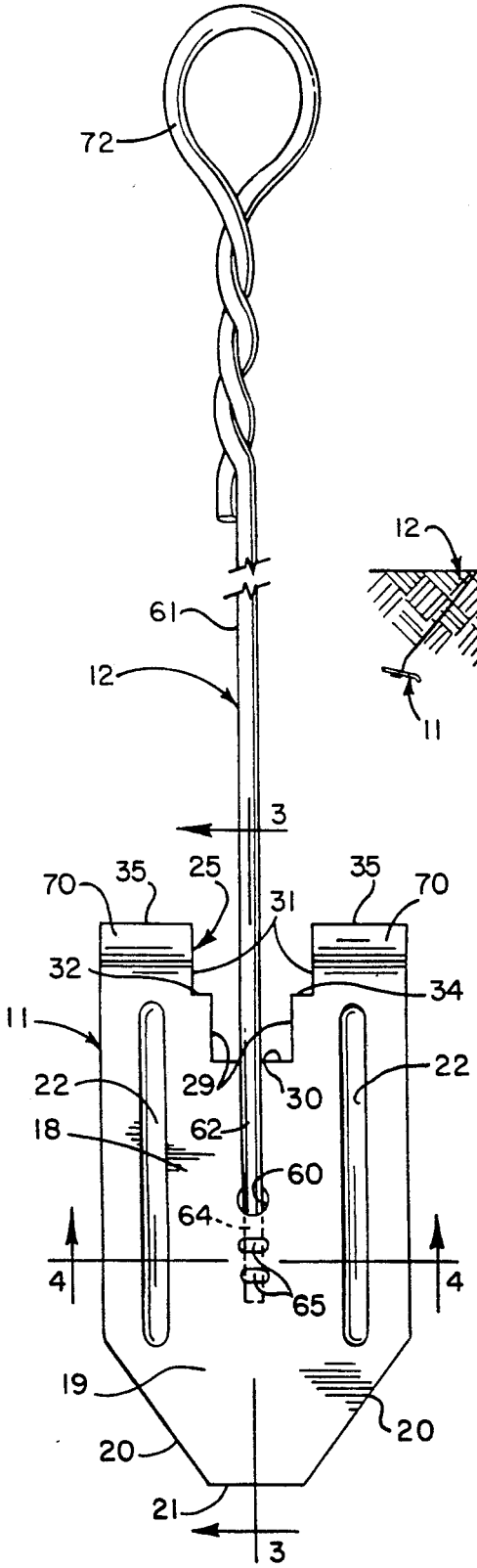
FIG. 2 is an enlarged plan view of one of the anchor plates and associated tie rod utilized in the illustrative system.

In carrying out the invention, to facilitate driving of the anchor plate deeply into the ground in a substantially straight path without premature disorientation or wandering of the anchor plate, the trailing end of the anchor plate is formed with a stepped notch 25 for receiving a complementary configured drive head 26 of an installation tool or drive rod 28. The notch 25 in this case includes a relatively narrow width section 29 extending into the anchor plate 11 from the trailing end thereof for defining a first bearing ledge 30 and a relatively wider rearward notch section 31 which defines second and third bearing ledges 32, 34 on opposite sides of the first notch 29 intermediate the first bearing ledge 30 and a trailing edge 35 of the anchor plate 11 (FIG. 2).

The drive rod head 26 is formed with a generally U-shaped groove 40 (FIG. 5) that defines a first bearing ledge 41 adapted for engaging the first bearing ledge 30 of the anchor plate 11 and second and third bearing ledges 42, 44 deposed upwardly from the first bearing ledge 41 on opposite sides of the head for engaging the second and third anchor plate bearing ledges 32, 34 (FIG. 7). The U-shaped groove 40 further defines a pair of forwardly and rearwardly spaced retention walls 45, 46 that are positionable on opposite sides of the anchor plate 11 about the entire parameter of the first notch 29. Hence, the retention walls 45, 46 defined by the groove 40 in the drive head 12 have portions extending downwardly on opposite sides of the first bearing ledge 30 and portions extending outwardly beyond the sides of the notch 29, as shown in FIGS. 6 and 7. By virtue of the interengaging relationship between the drive head 26 and the anchor 11, it can be seen that upon impacting of the upper end of the drive rod 28 by a heavy mallet 49 or jackhammer, the anchor plate 11 will be driven into the ground in the axial direction of the drive rod 28, with forces being transmitted downwardly through the first, second, and third anchor plate bearing ledges 30, 32, and 34, and with the drive head walls 45, 46 resisting turning and disorientation of the anchor plate during such downward movement into the earth. The illustrated drive head 26 has inwardly and downwardly tapered sides 50 disposed on opposite sides of the anchor plates 11 which facilitate downward movement of the drive rod head 28 into the ground with the anchor plate 11.

The drive rod head 26 in this instance is separate from the rod 28, preferably being formed of hardened steel. For securing the head 26 to the drive rod 28, the head 26 has a threaded aperture 5 extending into an upper end thereof for engagement by a threaded stem 52 of the drive rod 28. For positively preventing disengagement of the head 26 from the drive rod stem 52, an appropriate roll pen 53 (FIG. 6) may be press fit through aligned apertures in the head 26 and the stem 52, if desired.

For protecting the installer against injury when driving the anchor plate 11 into the ground and for facilitating removal of the drive rod 28 from the ground, the drive rod 28 has a cross bar 55 deposed transversely adjacent at the upper end thereof. In the event the workman driving the anchor plate 11 into the ground should accidentally miss the upper end of the drive rod 28 with the hammer 49, the cross bar 55 will prevent the hammer from engaging the hand of the installer gripping the drive rod 28 at a location below the cross bar 55. The cross bar 55 similarly will prevent the hammer from engaging and injuring the feet of the installer when the drive rod 28 is driven into the ground to such level that the cross bar 55 is approaching ground level. Upon driving of the anchor plate 11 into the ground to the desired depth, the cross bar 55 also may be used to facilitate removal of the drive rod 28 from the ground, either by striking the underside of the cross bar 55 with the mallet, or by pulling the drive rod 28 out of the ground by manually lifting the cross bar 55.

Figure 3:
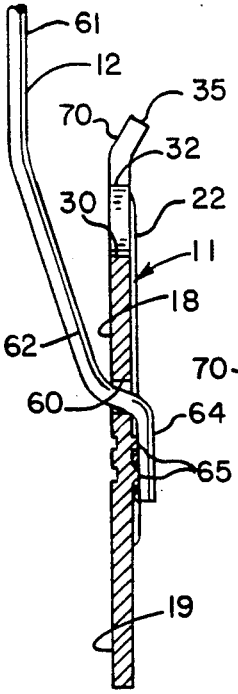
FIG. 3 is a vertical section of the anchor plate, taken in the plane of line 3—3 in FIG. 2, illustrating the manner in which the tie rod is secured to the anchor plate.
Figure 4:
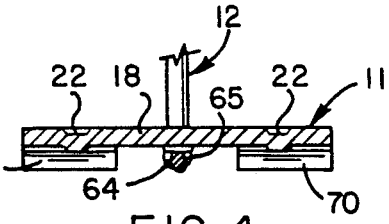
FIG. 4 is a transverse section, taken in the plane of line 4—4 in FIG. 2.

For securing the end of the tie rod 12 to the anchor plate 11, the anchor plate 11 is formed with an aperture 60 on the longitudinal axis thereof substantially midway along the length thereof (FIG. 2). The tie rod 12 in this instance has a substantially straight section 61 disposed parallel to a front face of the anchor plate 11, an inclined section 62 extending downwardly to the anchor plate and through the aperture 60 (FIG. 5), and a terminal mounting end 64 extending downwardly parallel to an opposite or rear side of the anchor plate 11 (FIG. 3). The terminal mounting end 64 of the tie rod 12 preferably is welded to the rear side of the plate 11, and to facilitate such welding, the rear side of the anchor plate is formed with a pair of outwardly extending longitudinally spaced dimples 65 upon which the terminal end 64 of the tie rod 12 is positioned and secured. The tie rod 12 preferably is formed of galvanized steel, such as 0.142 inch diameter 1008 or 1010 galvanized steel, which can be formed in the configuration illustrated in FIG. 5. With such configuration, it can be seen that the longitudinally extending section 61 of the tie rod 12 extends upwardly from the anchor plate 11 in outwardly spaced, parallel relation to the forward side thereof to provide ample clearance for engaging the drive rod head 26 in the anchor plate notches 29, 31.

In carrying out the invention, for setting the anchor plate into a substantially horizontal or "dead man's" position following being driven into the ground to the desired anchoring depth, the trailing end of the anchor plate 11 is formed with a pair of planning wings 70 which extend in rearwardly curved fashion away from the forward side of the anchor plate 11 from which the tie rod section 61 extends such that upward tensioning or pulling movement on the tie rod 12 causes the anchor plate 11 to be drawn in curvilinear fashion into proper setting position. The wings 70 in this instance are deposed on opposite sides of the drive rod head receiving notch 25. As shown in FIGS. 8 and 9, upon pulling of the tie rod, the curved wings 70 will engage the ground on the side of the anchor plate 11 causing it to veer upwardly and to the side to assume a horizontal or an inclined position substantially perpendicular to the longitudinally extending section 61 of the tie rod 12, with the connecting tapered section 62 being bent and deformed to permit such reorientation of the anchor plate 11. Such upward and sideward movement of the anchor plate 11 firmly embeds the plate into the ground in laterally offset relation to its path of travel downwardly into the ground.

The upper most end of the tie rod 12 in this case is formed with a pig tail eyelet 72 through which the drive rod 28 is positionable to facilitate tensioning of the tie rod 12 and setting of the anchor plate 11, as shown in FIG. 8. Once the anchor plate 11 is set in the ground, the guy wire 14 may be connected between the tie rod eyelet 72 and the above ground structure 15, as illustrated in FIG. 1. Not only does the substantially flat anchor plate 11 facilitate passage of the anchor through frost lines and hard soil conditions, because of the relatively large surface area created by the plate-like configuration, once set in the ground, the anchor plate 11 has been found to provide effective anchoring even in relatively sandy or loose soil conditions.

Following use of the anchor system 10, it is desirable that the anchor plate 11 and its tie rod either be removed from the ground or that it be deposed below ground level a sufficient distance so as not to create a safety hazard or to impede operation of power mowers and the like. To facilitate driving anchor plate tie rods into the ground after they have been cut to ground level following use, the cross bar 55 of the drive rod 28 is formed with a V notch 74 one end thereof that is engageable with the remaining exposed end of the rod 12. Upon positioning of the notched end 74 of the cross bar 55 into engaging relation with the exposed anchor tie rod, the opposite end of the cross bar 55 may be hammered to drive the tie rod several inches below ground level.

Figure 10:
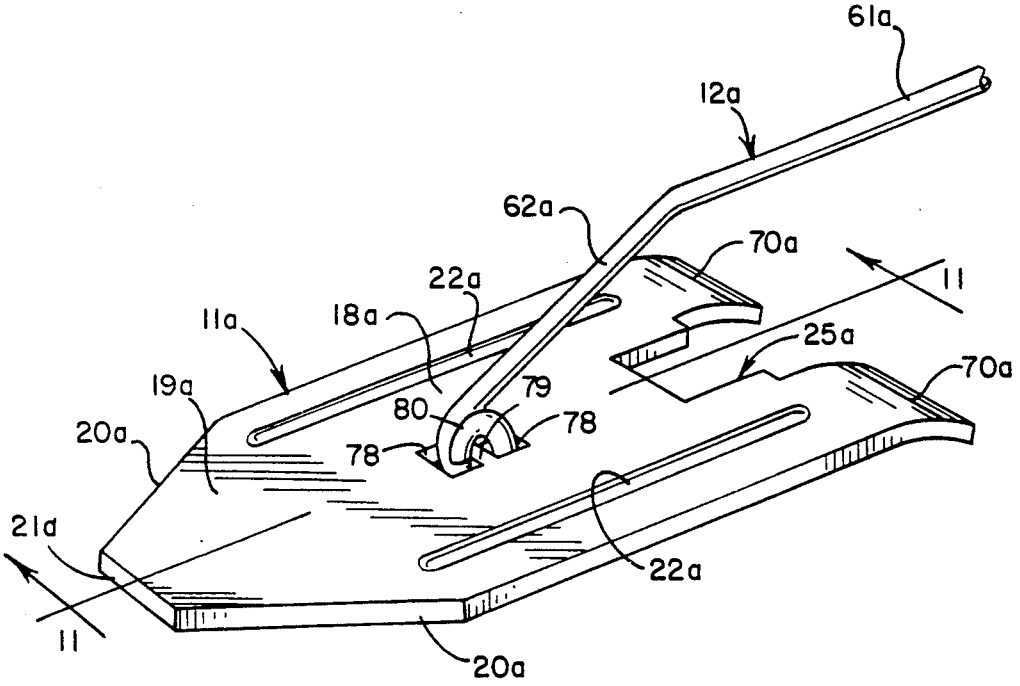
FIG. 10 is an enlarged perspective of an alternative embodiment of anchor according to the invention.
Figure 11:
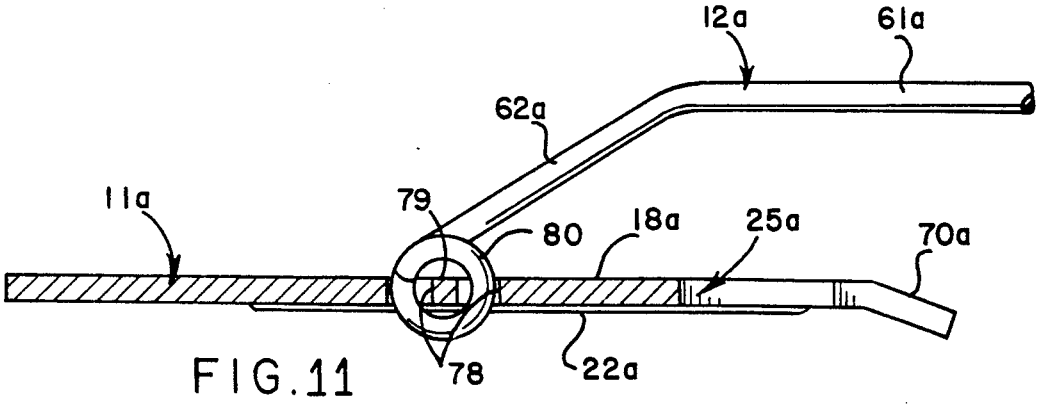
FIG. 11 is an enlarged vertical section, taken in the plane of line 11—11 in FIG. 10.

Referring now to FIGS. 10 and 11, there is shown an alternative embodiment of anchor plate 11*a* wherein items similar to those described above have been given similar reference numerals with the distinguishing suffix "*a*" added. The anchor plate 11*a* and associated tie rod 12*a* are particularly adapted for larger and heavier anchoring requirements. Like the anchor plate 11 previously described, the anchor plate 11*a* has a plate-like body portion 18*a*, a tapered forward end 19*a*, and rearwardly curved wings 70*a* at the trailing end. Stiffening recesses 22*a* similarly extend along opposite sides of the anchor plate 11, and a drive rod head receiving notch 25*a* is formed in the trailing end.

The anchor plate 11*a* in this case is formed with a pair of centrally deposed apertures 78 on the longitudinal axis thereof which define an integral tie-rod retaining cross brace 79 about which an eyelet 80 in the lower end of the tie rod 12*a* encompasses for securing the anchor plate 11*a* for relative pivotal movement. The anchor plate 11*a* and tie rod 12*a* in this case are freely rotatable relative to each other, and hence, do not require deformation of the tie rod 12*a* upon setting of the anchor plate 11*a*, which may be more difficult by virtue of the heavier gauge tie rod required in larger anchoring requirements.

From the foregoing, it can be seen that the earth anchor of the present invention is adapted for easier and faster installation into the ground, even through relatively hard frost lines. The relatively large surface area of the anchor plate provides for greater and improved anchoring over prior tubular or cylindrical anchors. The anchor plate further can be reliably driven straight into the ground without turning and disorientation, and the simplicity of design facilitates economical manufacture.

What is claimed is:

1. An earth anchor for supporting an above the ground structure comprising an anchor plate having a substantially flat co-planar body portion with a leading ground entry end and a trailing end, said anchor plate being drivable into the ground in substantially upright condition to a desired anchoring depth by compacting a drive rod engageable with said trailing end of the anchor plate and extending upwardly therefrom out of the ground for connection to the above ground structure to be supported, said anchor plate having wing means at the trailing end angled out of the plane of said body portion for guiding said anchor plate into a substantially horizontal anchoring position upon tensioning of the tie rod following driving of the anchor plate to a desired anchoring depth, said anchor plate being formed with an aperture intermediate its ends on a longitudinal axes of said anchor plate, said tie rod being pre-formed with a first section disposed in substantially parallel outwardly spaced relation to said one side of said anchor plate, an inclined section extending from the end of said first section through said anchor plate aperture, and a terminal end section disposed in parallel relation to said opposite side of said anchor plate, means securing said terminal end section to said opposite side of said anchor plate, and said inclined tie rod section being deformable upon movement of said anchor plate to said anchoring positioning in response to tensioning of said tie rod.

2. The earth anchor of claim 1 in which said tie rod extends upwardly from one side of said anchor plate and said wing means are curved outwardly out of the plane of said body portion in the direction of an opposite side of said plate.

3. The earth anchor of claim 2 in which said anchor plate is formed with a drive rod receiving notch in said trailing end, and said wing means comprise a pair of curved wings disposed on opposite sides of said notch.

4. The earth anchor of claim 1 in which said terminal end of the tie rod is welded to said opposite side of said plate.

5. The earth anchor of claim 4 in which said anchor plate is formed with a plurality of dimples on said opposite side of said plate upon which said terminal tie rod end is welded

6. The earth anchor of claim 3 in which said anchor plate notch includes a first relatively narrow width notch section extending into said plate from the trailing end thereof for defining a first bearing ledge and a second relatively wider notch section for defining second and third bearing ledges disposed on opposite sides of said first notch intermediate said first bearing ledge and a trailing edge of said anchor plate.

7. The earth anchor of claim 1 in which said anchor plate has a tapered leading end.

8. The earth anchor of claim 7 in which said leading end of said anchor plate is formed with a pair of forwardly and downwardly tapered sides with a transverse leading edge.

9. The earth anchor of claim 1 in which said anchor plate is formed with a plurality of longitudinally extending rigidifying recesses.

10. The earth anchor of claim 9 in which said rigidifying recesses are disposed adjacent opposite sides of said anchor plate.

11. An earth anchor installation system comprising an anchor plate having a tie rod connected thereto, a drive rod engageable with a trailing end of said anchor plate which upon impacting of an upper end thereof is adapted for driving the anchor plate into the ground in substantially upright condition to a desired anchoring depth, said anchor plate having a substantially flat coplanar body portion with a leading ground entry end and a trailing end, said tie rod being connected intermediate the ends of said anchor plate and extending upwardly therefrom out of the ground for connection to the above ground structure to be supported, said anchor plate having wing means at the trailing end angled out of the plane of said body portion for guiding said anchor plate into a substantially horizontal anchoring position upon tensioning of the tie rod following driving of the anchor plate to a desired anchoring depth, said anchor plate being formed with a drive rod engagement notch in said trailing end for engagement by said drive rod during driving of said anchor plate into the ground, said anchor plate notch including a first relatively narrow width notch section extending into said plate from the trailing end thereof for defining a first bearing ledge and a second relatively wider notch section for defining second and third bearing ledges disposed on opposite sides of said first notch intermediate said first bearing ledge and a trailing edge of said anchor plate, and said drive rod having a drive head formed with a first bearing ledge engageable with the first bearing ledge of said anchor plate and a second and third bearing ledges disposed upwardly from said first ledge for engagement with said second and third anchor plate bearing ledges for maintaining said anchor plate in substantial alignment with said drive rod during driving movement of the anchor plate into the ground.

12. The earth anchor system of claim 11 in which said drive rod head is formed with forward and rearwardly spaced retention walls for positioning adjacent opposite side of the trailing end of said anchor plate about said first notch.

13. The earth anchor system of claim 12 in which said first, second and third drive rod head bearing ledges and said retention walls are defined by a U-shaped groove formed in said drive rod head.

14. The earth anchor system of claim 11 in which said drive rod has a handle section and a separate hardened head secured thereto.

15. The earth anchor of claim 14 in which said drive rod head is threadedly engageable with said handle section.

16. The earth anchor system of claim 13 in which said drive rod head has forwardly and downwardly tapered sides on opposite sides of said groove.

* * * * *